US005373890A

United States Patent [19]

Taketsu et al.

[11] Patent Number: 5,373,890

[45] Date of Patent: Dec. 20, 1994

[54] HORIZONTAL CONTINUOUS CASTING METHOD AND ITS DEVICE

[75] Inventors: Yoshihiro Taketsu; Eichi Miyazu; Iwao Asamizu; Naotake Wada; Kenji Kubozono, all of Sagamihara, Japan

[73] Assignee: Mitsubishi Denki Kabushiki Kaisha, Tokyo, Japan

[21] Appl. No.: 162,803

[22] Filed: Dec. 7, 1993

Related U.S. Application Data

[63] Continuation of Ser. No. 914,600, Jul. 20, 1992, abandoned.

[30] Foreign Application Priority Data

Sep. 6, 1991 [JP] Japan ..... 3-227070

[51] Int. Cl.[5] ..... B22D 11/04; B22D 11/10

[52] U.S. Cl. ..... 164/490; 164/440

[58] Field of Search ..... 164/490, 440

[56] References Cited

U.S. PATENT DOCUMENTS

| | | | |
|---|---|---|---|
| 3,286,309 | 11/1966 | Brondyke et al. | 164/490 |
| 3,593,778 | 7/1971 | Foye | 164/440 X |
| 3,903,955 | 9/1975 | Antoine et al. | 164/440 |

FOREIGN PATENT DOCUMENTS

| | | | |
|---|---|---|---|
| 1398272 | 3/1965 | France . | |
| 1398275 | 3/1965 | France . | |
| 2604478 | 8/1977 | Germany . | |
| 7603240 | 3/1978 | Germany . | |
| 2707533 | 8/1978 | Germany . | |
| 60-130456 | 7/1985 | Japan . | |
| 60-180646 | 9/1985 | Japan . | |
| 61-150750 | 7/1986 | Japan | 164/490 |
| 61-209758 | 9/1986 | Japan | 164/488 |
| 2-224849 | 9/1990 | Japan | 164/440 |
| 2003064A | 3/1979 | United Kingdom | 164/440 |
| 921671 | 4/1982 | U.S.S.R. | 164/490 |
| 988446 | 1/1983 | U.S.S.R. | 164/490 |

OTHER PUBLICATIONS

Patent Abstracts of Japan, vol. 10, No. 100 (M-470)(2157), Apr. 16, 1986, JP-A-234 740, Nov. 21, 1985.

Soviet Inventions Illustrated, Oct. 2, 1986, AN 86-250865/38, SU-A-1 209 361, Feb. 7, 1986.

*Primary Examiner*—J. Reed Batten, Jr.

*Attorney, Agent, or Firm*—Oblon, Spivak, McClelland, Maier & Neustadt

[57] ABSTRACT

A molten metal stored in a heat-reserving furnace is maintained at a constant temperature by heating the molten metal by a heating source. The molten metal in the heat-reserving furnace is then introduced into a mold by passing the molten metal through a gate made of a refractory with the molten metal then passed through a casting space in the horizontal direction, to thereby cast a cast block.

6 Claims, 2 Drawing Sheets

HORIZONTAL CONTINUOUS CASTING METHOD AND ITS DEVICE

This application is a continuation of application Ser. No. 07/914,600, filed on Jul. 20, 1992, now abandoned.

BACKGROUND OF THE INVENTION

1. Field of the Invention

This invention relates to a horizontal continuous casting method and its device, and particularly to a horizontal continuous casting method and its device suitable for casting a copper alloy.

2. Discussion of the Background

FIG. 5 is a sectional view showing a conventional horizontal continuous casting device for a copper alloy. In FIG. 5, a reference numeral 1 designates a heat-reserving furnace, 2, a molten metal stored in the heat-reserving furnace 1, 3, a heating unit formed in the heat-reserving furnace 1, 4, an electric power heater for heat reservation provided at the heating unit 3, 5, a graphite mold provided at a side face of the heat-reserving furnace 1 in the horizontal direction, 6, a molding space formed in the graphite mold 5, so as to cast a cast block 7 by passing the molten metal 2 therethrough, and 8, a water jacket provided around the graphite mold 5 so that it covers over the peripheral portion thereof.

In the conventional horizontal continuous casting device constructed as above, an inlet for molten metal 9 of the graphite mold 5 is in an open state. The molten metal 2 stored in the heat-reserving furnace 1, enters the casting space 6 of the graphite mold 5 through the inlet for molten metal 9, and the cast block 7 is molded by cooling the molten metal 2 by cooling water passing in the water jacket 8. The continuous casting is performed by extracting the cast block 7 in the horizontal direction. In the heat-reserving furnace 1, the molten metal 2 is maintained at a constant temperature by ON-OFF or repetition of switching of electricity feeding quantity, of the electric power heater for heat reservation 4.

In case of a vertical continuous casting method, casting is performed in a downward flow. Therefore, a method is known wherein a flow-resistant portion is provided at a casting nozzle which connects a tundish and a mold to prevent picking-up of nonmetallic inclusion such as casting powders, thereby decreasing a downward flow rate of the molten metal and accelerating a floating separation of the nonmetallic inclusion (for example Japanese Unexamined Patent Publication No. 130456/1985). In the horizontal continuous casting method, since the nonmetallic inclusion floats up on the surface of the molten metal 2 in the heat-reserving furnace 1, as shown in FIG. 5, no consideration is given thereto.

However, in the conventional horizontal continuous casting method and the device as stated above, since the molten metal 2 in the heat-reserving furnace 1 is maintained at a constant temperature by ON-OFF or switching of the electricity feeding quantity of the electric power heater for heat reservation 4, convection is always caused in the molten metal 2, and a considerable temperature variation is caused in the molten metal just before casting solidification in the graphite mold 5. Accordingly, a thermal stress is generated by a nonuniform temperature distribution generated in the cast block during the casting, whereby casting cracks are caused, or breakout (breakage of cast block) is generated due to insufficient deformation resistance thereof with respect to a change in resistance during the extraction.

SUMMARY OF THE INVENTION

It is an object of the present invention to solve the above conventional problems. It is an object of the present invention to provide a horizontal continuous casting method and its device capable of preventing the temperature variation and the nonuniform temperature distribution of the molten metal in the mold, thereby preventing the generation of the casting cracks and the breakout.

According to a first aspect of the present invention, there is provided a horizontal continuous casting method comprising steps of:

maintaining a molten metal stored in a heat-reserving furnace at a constant temperature by heating the molten metal by a heating source;

introducing the molten metal in the heat-reserving furnace into a mold by passing the molten metal through a gate made of a refractory; and passing the molten metal through a casting space in the horizontal direction, thereby casting a cast block.

According to a second aspect of the present invention, there is provided the horizontal continuous casting method according to the first aspect, wherein the gate is made of graphite or ceramics.

According to a third aspect of the present invention, there is provided the horizontal continuous casting method according to the first aspect or the second aspect wherein the gate is provided with a plurality of holes or slits.

According to a fourth aspect of the present invention, there is provided a horizontal continuous casting device comprising;

a heat-reserving furnace for storing a molten metal;

a heating source for heating the molten metal stored in the heat-reserving furnace;

a mold connected to a side face of the heat-reserving furnace so as to introduce the molten metal from the heat-reserving furnace and to pass the molten metal through a casting space in the horizontal direction, thereby casting a cast block; and a gate made of a refractory provided at a side of the mold for entering the molten metal.

In the horizontal continuous casting method and the device of this invention, the molten metal is stored in the heat-reserving furnace, the temperature of which is maintained to a constant temperature by heating it by a heating source. The molten metal in the heat-reserving furnace, is introduced in the mold through the gate. The cast block is produced by passing the molten metal through the casting space in the horizontal direction.

When the molten metal passes through the gate, the temperature variation and the nonuniform temperature distribution thereof is prevented by a rectifying action of the gate. By this means, the temperature distribution of the cast block during casting becomes uniform and the thermal stress is not generated. Accordingly, the casting cracks are not caused, and the breakout in the extraction is not generated, thereby producing a cast block having an uniform and good quality.

By utilizing a gate made of graphite or ceramics, no damage is caused in the gate by the molten metal, and the rectifying action is maintained during a long period. Furthermore, by uniformly providing the gate with holes or slits, the rectifying action can be performed uniformly.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
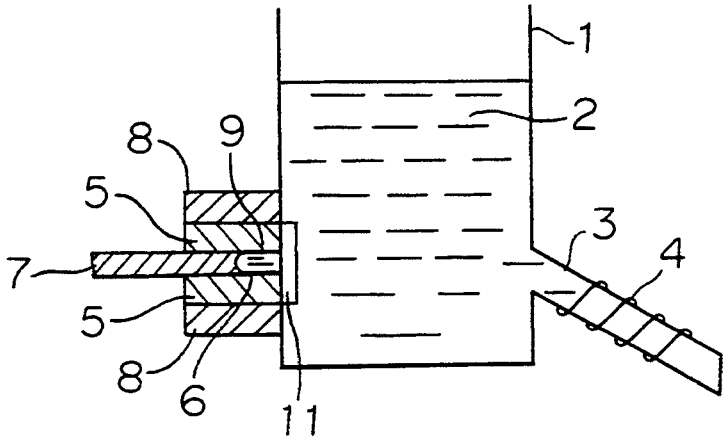
FIG. 1 is a sectional view of an embodiment of a horizontal continuous casting device.
Figure 2:
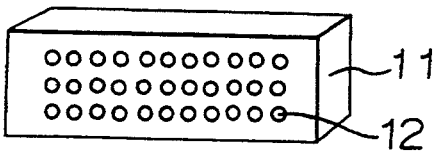
FIG. 2 is a perspective view of a gate of an embodiment.
Figure 3:
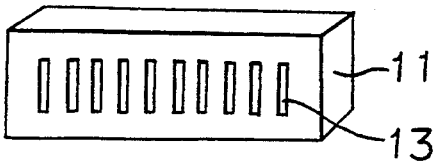
FIG. 3 is a perspective view of a gate of another embodiment.
Figure 5:
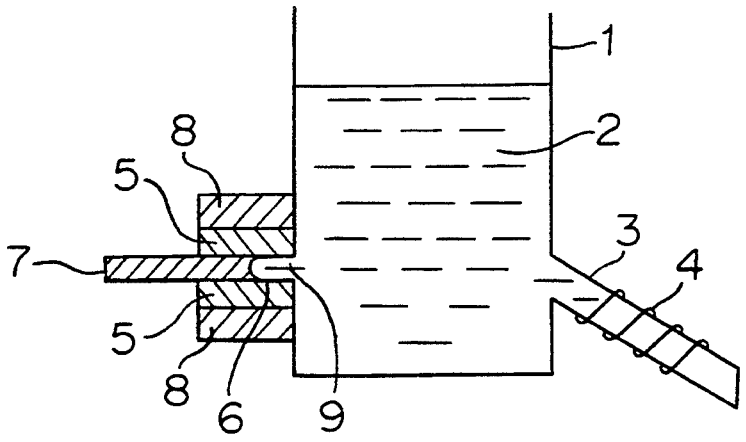
FIGURE 5 PRIOR ART
FIG. 5 is a sectional view of a conventional horizontal continuous casting device.

FIG. 1 is a sectional view showing an embodiment of a horizontal continuous casting device for copper alloys. FIGS. 2 and 3 are perspective views respectively showing gates of embodiments of this invention. FIGS. 1, 2 and 3, the same notation as in FIG. 5 designates the same or the corresponding portion.

In FIG. 1, the heat-reserving furnace 1 and the graphite mold 5 are constructed almost similar to those in the conventional example. However, a gate 11 made of a refractory is provided at a side wall portion of the heat-reserving furnace 1 on the side of the inlet for molten metal 9 of the graphite mold 5. In the gate 11, a great number of circular holes (through holes) 12 are provided as in FIG. 2, or a great number of slits 13, as in FIG. 3, respectively at portions corresponding to the casting spaces 6. The other construction is the same as in FIG. 5.

In the casting method by the above horizontal continuous casting device, first, the molten metal 2 is stored in the heat-reserving furnace 1, and temperature of the molten metal 2 is maintained at a constant temperature by ON-OFF or by switching the electricity feeding quantity of the electric power heater for heat reservation 4. Furthermore, the molten metal 2 in the heat-reserving furnace 1, is rectified of its flow passing through the gate 11, and is introduced in the casting space 6 of the graphite mold 5. In this way, the molten metal 2 of which flow is rectified, passes through the casting space 6 in the horizontal direction, and is cooled by the water jacket 8, thereby producing the cast block 7. By extracting the formed cast block 7 in the horizontal direction, the molten metal 2 in the heat-reserving furnace 1 is introduced in the casting space 6 through the gate 11, thereby performing the continuous casting.

The molten metal 2 in the heat-reserving furnace 1 receives the rectifying action by passing through the holes 12 or the slits 13 of the gate 11. Accordingly, the temperature variation of the molten metal 2 flown in the casting space 6 is not generated and the temperature distribution thereof becomes uniform, even when the molten metal 2 in the heat-reserving furnace 1 convects. In this way, the temperature distribution of the cast block 7 during casting becomes uniform, and no casting crack or breakout is caused in the cast block 7.

Explanation will be given to test examples as follows.

The horizontal continuous casting of a copper alloy composed of 2 wt. % of Ni and the balance of copper, is performed by the horizontal continuous casting device of FIGS. 1, 2 and 3. The size of the section of the cast block 7 is 15 mm×450 mm and the casting rate is 110 mm/min. Table 1 shows a cast quantity until breakout (ton), cast block quality, and quality of a product rolled to a thickness of 0.25 mm, including the cases wherein the casting is performed by utilizing the gate 11 as specified in Table 1.

TABLE 1

| Test No. | Gate | Cast quantity until breakout (ton) | Cast block quality | Product quality (t = 0.25 mm) | Remarks |
|---|---|---|---|---|---|
| 1 | None | 3.2 | Casting cracks | Scattered fine cracks | Conventional method |
| 2 | None | 1.8 | Casting cracks | Impossible to produce | Conventional method |
| 3 | None | 3.5 | Casting cracks | Scattered fine cracks | Conventional method |
| 4 | Thickness; 5 mm, graphite hole 4 mmϕ; 120 | ≧10 | Good | Three fine cracks | Invented method |
| 5 | Thickness; 5 mm, graphite hole 3 mmϕ; 150 | ≧10 | Good | Good | Invented method |
| 6 | Thickness; 5 mm, graphite slit 3 × 10 mm; 20 | 8.5 | Good | Good | Invented method |
| 7 | Thickness; 5 mm, graphite hole 3 mmϕ; 150, divided in two | ≧10 | Good | Good | Invented method |

According to the result of Table 1, a considerable improvement is observed in the cast block quality and the breakout, by utilizing the gate 11.

Figure 4:
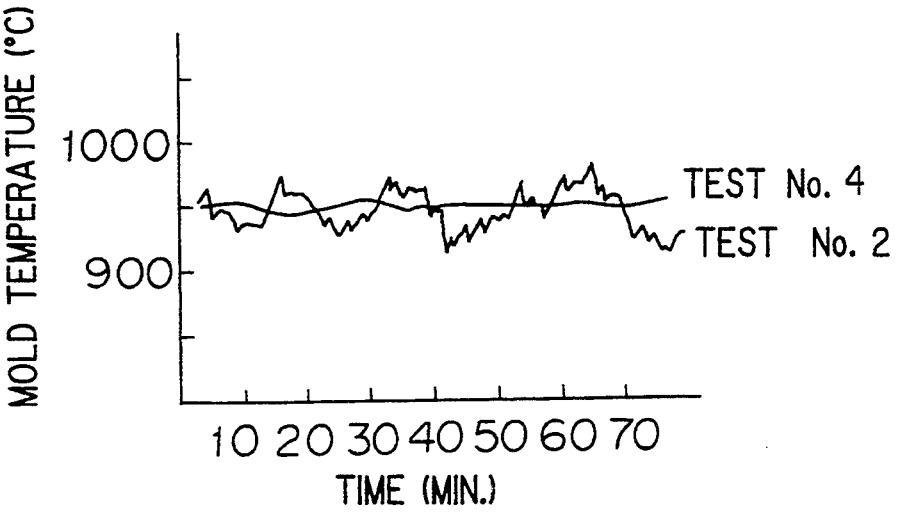
FIG. 4 is a graph showing a result of a test.

FIG. 4 shows a result of measuring a temperature of the graphite mold 5 with respect to Tests No. 2 and No. 4. The location for the measurement is at a portion of upper central wall in width and middle in thickness thereof, 50 mm apart from the inlet for molten metal 9 of the graphite mold 5. According to the result of FIG. 4, it is found that the temperature variation just after the cast block solidifies, is considerably restrained by providing the gate 11, and the temperature becomes constant.

Furthermore, by utilizing the gate 11 made of graphite or ceramics, no damage is caused thereon by the molten metal, and the rectifying action can be maintained for a long period. Particularly, graphite is preferable. However, the gate 11 made of other refractories can be utilized. By uniformly providing the holes 12 or the slit 13 in the gate 11, the rectifying action can uniformly be performed. The shape, the arrangement or the like thereof is not restricted to the illustrated ones. For instance, mesh-like ones can be utilized. The gate 11 may be of a one-piece body, divided bodies, or an integrated body of a plurality of kinds thereof.

According to the horizontal continuous casting method and the device of this invention, a gate made of a refractory is provided at the side of the inlet for molten metal for casting, thereby performing the horizontal continuous casting. Accordingly, the temperature variation and the nonuniform temperature distribution of the molten metal in the mold, can be prevented, thereby preventing the generation of the casting cracks, the breakout or the like, and producing a cast block having an excellent quality.

In case that the gate made of graphite or ceramics is utilized, no damage is caused thereon by the molten metal, and the effect can be maintained during a long period. Furthermore, when the holes or the slits are uniformly provided in the gate, this invention is excellent in the effect of uniformly performing the rectifying action and making the temperature distribution uniform.

Obviously, numerous modifications and variations of the present invention are possible in light of the above teachings. It is therefore to be understood that within the scope of the appended claims, the invention may be practiced otherwise than as specifically described herein.

What is claimed is:

1. A horizontal continuous casting method comprising the steps of:

maintaining a molten metal stored in a heat-reserving furnace at a constant temperature by heating the molten metal by a heating source;

introducing the molten metal in the heat-reserving furnace into a mold by passing the molten metal through a gate made of a refractory located adjacent a side wall of the heat-reserving furnace and inside of said heat-reserving furnace such that the molten metal passes through said gate immediately prior to exiting said heat-reserving furnace and immediately prior to entering said mold, the step of introducing the molten metal through said gate further including introducing the molten metal through a gate which includes a plurality of openings uniformly distributed across both central and peripheral portions of a communication passage extending between said heat-reserving furnace and said mold, thereby providing a more uniform temperature of said molten metal during the step of introducing the molten metal surface into said mold.

2. The horizontal continuous casting method according to claim 1, wherein the gate is made of graphite or ceramics.

3. The horizontal continuous casting method according to claim 1 or claim 2 wherein the gate is provided with a plurality of holes or slits.

4. A horizontal continuous casting device comprising:

a heat-reserving furnace for storing a molten metal;

a heating source for heating the molten metal stored in the heat-reserving furnace;

a mold connected to a side face of the heat-reserving furnace so as to introduce the molten metal from heat-reserving furnace and to pass the molten metal through a casting space in the horizontal direction, thereby casting a cast block; and a gate made of a refractory, said gate disposed adjacent a side of said heat-reserving furnace and inside said heat-reserving furnace such that the molten metal passes through said gate immediately prior to exiting said heat reserving furnace and immediately prior to entering said mold, said gate further including a plurality of openings uniformly distributed across both central and peripheral portions of a communication passage extending between said heat-reserving furnace and said mold, said gate thereby reducing temperature variation in the molten metal prior to introduction of the molten metal into the mold and thereby reducing cracking and breakout during casting.

5. The horizontal continuous casting device of claim 4, wherein said plurality of openings includes a rectangular array of openings.

6. The horizontal continuous casting device of claim 4, wherein said gate has a thickness of approximately 5 mm.

* * * * *